United States Patent [19]

Seragnoli

[11] 3,990,213

[45] Nov. 9, 1976

[54] APPARATUS FOR TRANSFERRING NEWLY PRODUCED CIGARETTES OR THE LIKE TO A PACKETING MACHINE

[75] Inventor: Enzo Seragnoli, Bologna, Italy

[73] Assignee: G. D. Societa per Azioni, Italy

[22] Filed: Nov. 8, 1974

[21] Appl. No.: 522,296

[30] Foreign Application Priority Data

Nov. 21, 1973 Italy ..... 3533/73

[52] U.S. Cl. ..... 53/59 R; 53/151; 214/302

[51] Int. Cl.[2] ..... B65B 57/06; B65F 3/02

[58] Field of Search ..... 53/59 R, 151; 214/302

[56] References Cited

UNITED STATES PATENTS

| | | | |
|---|---|---|---|
| 2,745,410 | 5/1956 | Molins | 53/59 R X |
| 2,997,828 | 8/1961 | Ahlbor | 53/59 R |
| 3,297,138 | 1/1967 | McCombie | 53/59 R X |
| 3,383,830 | 5/1968 | Dearsley | 53/59 R X |
| 3,735,767 | 5/1973 | Kruse et al. | 53/236 X |
| 3,854,611 | 12/1974 | Wahle | 214/302 |

*Primary Examiner*—Travis S. McGehee
*Attorney, Agent, or Firm*—Robert E. Burns; Emmanuel J. Lobato; Bruce L. Adams

[57] ABSTRACT

Apparatus for transferring cigarettes from a continuous, variable supply flow thereof, supplied by a cigarette producing machine, to a cigarette packeting machine, at a rate to suit the capacities of both machines. Apportioning means accumulate a quantity of newly produced cigarettes from the supply flow in a zone spaced vertically above, and spaced horizontally from, an intake hopper of the packeting machine. Transportation means move the accumulated quantity of cigarettes horizontally to and vertically into the intake hopper, and discharge it therein when the operation of the packeting machine has lowered the supply of cigarettes in the hopper below a certain level.

6 Claims, 3 Drawing Figures

APPARATUS FOR TRANSFERRING NEWLY PRODUCED CIGARETTES OR THE LIKE TO A PACKETING MACHINE

BACKGROUND OF THE INVENTION

This invention has as its subject an apparatus for directly supplying the hopper or hoppers of one or more packeting machines with cigarettes taken from a continuous flow exiting from one or more cigarette producing machines.

DESCRIPTION OF THE PRIOR ART

A system is known wherein cigarettes taken from a continuous flow exiting from one or more cigarette producing machines are directly supplied to the inside of the hopper or hoppers of one or more cigarette packeting machines. In the known systems means were provided to enable there to be variations in the volume (reserves) of the mass of cigarettes, to suit both the output capacity of the cigarette producing machines and the handling possibilities of the packeting units.

SUMMARY OF THE INVENTION

The object of the present invention is, instead, to make available an apparatus with which the hopper of a packeting machine can be directly supplied with cigarettes exiting in a continuous fashion from the cigarette producing machine or machines, the supplying being conducted intermittently at a speed to suit the handling capacity of the packeting machine and the output potential of the source of cigarettes.

A further object of the invention is to provide a similar apparatus which is able to remove cigarettes from the continuous flow and to deposit them directly inside the hopper of the packeting machine.

Yet another object of this invention is to provide an apparatus of the nature stated above wherein the removal of the cigarettes from the continuous flow and the consequential placing of them inside the hopper of the packeting machine are governed by the quantity of cigarettes existing in the inside of the said hopper in such a way as to allow the depositing of the cigarettes to take place in a way that is nice and orderly, that is to say, so that the cigarettes are all parallel with one another.

A further object still of the present invention, though not the last, is to cater for the possibility that the apparatus may have to operate at high supply speeds so as to fall in line with the high production speed of present day packeting machines of the type, by way of an example, according to U.S. Pat. No. 3,628,309 assigned to the assignee hereof.

These and other objects too have all been attained by the apparatus according to the present invention for directly supplying the hopper of one or more packeting machines with cigarettes taken from a continuous flow exiting from one or more cigarette producing machines. The new apparatus comprises separator means for apportioning cigarettes in succession from said continuous flow, and transportation means for receiving and moving the cigarettes, at a speed synchronized with that of the separator means, to a discharge point in the inside of the hopper, said discharge point being determined by the level of the cigarettes existing internally in the hopper.

BRIEF DESCRIPTION OF THE DRAWINGS

Further characteristics and advantages will emerge more clearly from the following detailed description of a preferred but not the sole form of embodiment for the apparatus according to the invention, illustrated purely as an example on the accompanying drawings in which.

DESCRIPTION OF THE PREFERRED EMBODIMENT

Figure 1:
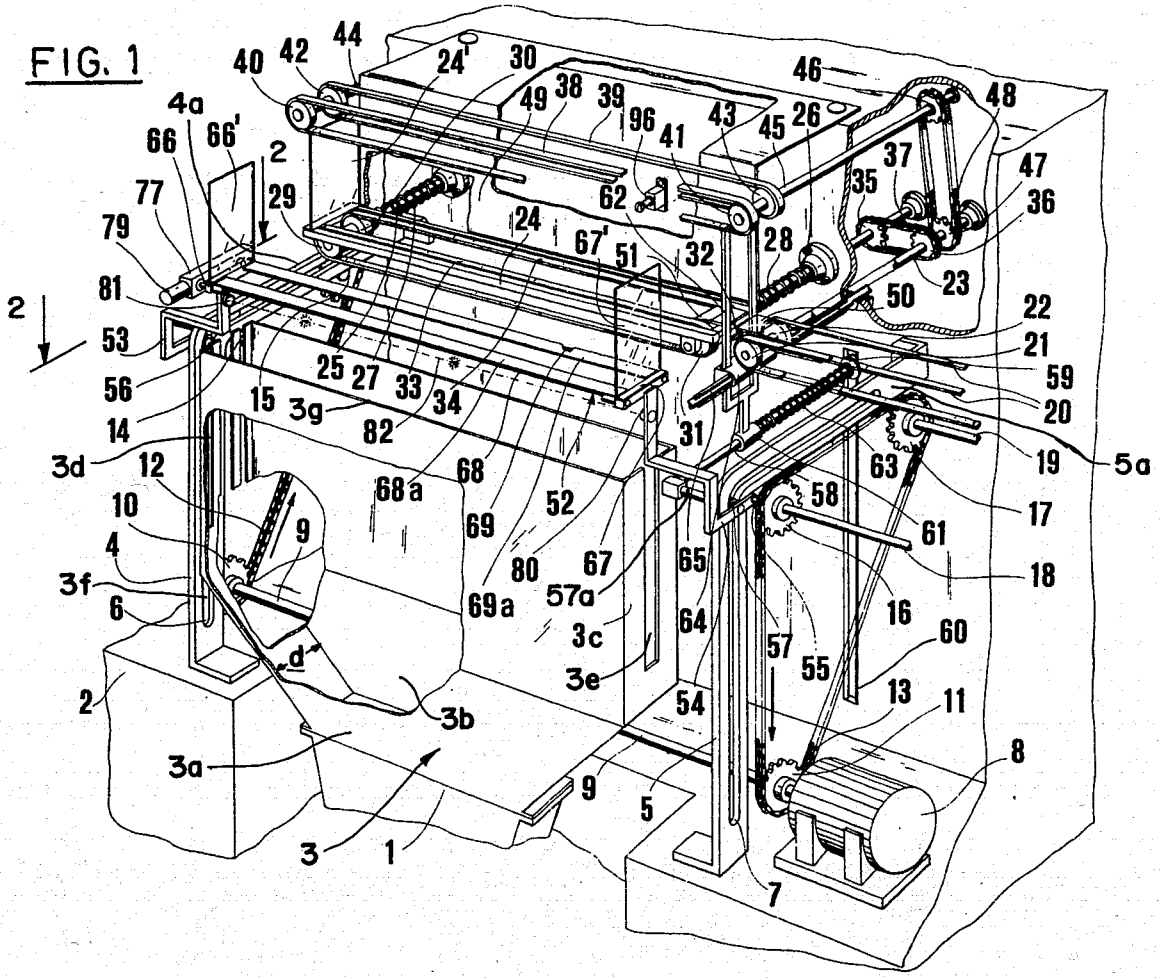
FIG. 1 shows, in a perspective view, the apparatus with certain parts broken off so that others can be seen.

With reference to FIG. 1, it can be seen that above an ordinary type hopper 1 carried by a frame 2 of a cigarette collating/packeting machine of no particular type, there is a hopper or tank 3 fastened in any way to the said frame 2 by means which are not shown on the drawings. The hopper 3, as shown has vertical, parallel front and rear walls 3*a*, 3*b*, the latter being spaced from the former by a slight distance *d*, so that the entire hopper extends in the vertical planes of these walls. The hopper has sidewalls 3*c*, 3*d* having vertical slots 3*e*, 3*f* therein, as also shown.

Two upright guide members 4 and 5 are provided and these are fixed to the frame 2 on opposite sides of the hopper 3. Each upright guide member 4, 5 has, on its upper extremity, a horizontal section 4*a*, 5*a* and each has a slit in it, 6 and 7, respectively, running both in the vertical part and in the horizontal section.

At the side of the upright member 5, the frame 2 supports an electric geared motor 8, the drive shaft 9 of which extends parallel with and behind the vertical rear wall 3b, of the hopper 3, to the upright member 4, as shown. In the proximity of the upright members 4 and 5, the drive shaft 9 has mounted on it sprockets 10 and 11, the teeth of which mesh with chains 12 and 13, respectively, wound in closed ring fashion around intermediate sprockets 14–15 and 16–17, respectively, each of which loosely mounted on its own spindle, the sprockets 14, 16 being mounted adjacent front ends of horizontal guide sections 5*a*, 4*a*, respectively, while the sprockets 15, 17 are mounted adjacent rear ends of these sections. The only spindles visible on the drawings are 18 and 19, for the sprockets 16 and 17; they are supported in any known way by frame 2 of the machine.

On the side of the frame 2 where the geared motor 8 is positioned, at a higher level than that of the upper edge 3*g* of the hopper 3 and between vertical plane behind those of hopper 3, there is a conveyor on which the cigarettes, arriving from a cigarette producing machine, not shown on the drawings, are carried in bulk.

As depicted, the conveyor is of the type which has two parallel belts 20, each wound in closed ring fashion around its own pulleys. Two of these, namely 21 and 22, can be seen in FIG. 1. They are rigidly mounted on a shaft 23 which penetrates inside the frame 2, where it is driven by mechanical connections, not shown.

As a continuation of the conveyor belt 20, a horizontal frame 24 is provided at the front of the hopper 3 and this is supported at its opposite ends by two shafts 25 and 26 in a sliding but not a rotatable fashion, with the interposition of springs 27 and 28 threaded on to the shafts 25 and 26. These shafts, in turn, are carried rotatably by the frame 2 inside which they penetrate.

Mounted on the said shafts 25 and 26 on the inside of the horizontal frame 24 are the pulleys 29–30 and 31–32 which are rotatable with the shafts but slide with respect thereto. Two belts 33 and 34 are mounted in closed ring fashion around the pairs of pulleys 29–31 and 30–32. The shaft 26 is driven by the shaft 23 through sprockets 35 and 36 and a chain 37.

Positioned above the frame 24 carrying the belts 33 and 34 there are two belts 38 and 39 and these are wound in closed ring fashion around pulleys 40–41 and 42–43 mounted on shafts 44 and 45, latter being driven by shaft 23 through sprockets 46 and 47 and a chain 48.

Between the belt 39 and the front of the frame 2, a plate 49, also carried by the frame 2, is provided and this extends downwards until it reaches a level slightly above that of the upper run of the belts 33 and 34 of the frame 24.

Furthermore, at 50 and 51 there are two fixed plates bridging the adjacent extremities of the pairs of belts 20 and 33–34, respectively, while a fixed wall member 24' carried by the frame 24 is positioned at a point corresponding to the other extremity of the said belts 33 and 34.

From the foregoing description and the drawing it will be understood that the frame 24 and the parts 25 to 51, cooperating therewith, constitute the aforementioned "separator means" for apportioning cigarettes in succession from the continuous flow provided by conveyor belts 20. Reference will now be made to parts 52 to 78, which will be similarly understood from the drawing and the following description to constitute the aforementioned "transportation means" for receiving and moving cigarettes to a discharge point in the inside of the hopper 3. Thus it will also be possible to designate the belts 20 as a "first conveyor", and to designate the transportation means 52 to 78 as a "second conveyor".

At 52, shown in front of frame 24 and above hopper 3, there is a rectangular frame connected to the chains 12 and 13 at 55 through brackets 53 and 54, each of which is provided with an idle roller 56 and 57, respectively, which runs in a guided fashion in the slit 6 and 7 of the guide members 4 and 5, respectively.

A shaft 57a carrying the idle roller 57 is connected to one end of a rod 58, the other extremity of which has loosely mounted on it an idle roller 59 which runs in a guided fashion in a vertical slot 60 in the frame 2. The rod 58 has loosely threaded on it a sleeve 61, rigid with a fork shaped member 62 with vertical prongs which extend in a vertical plane between the adjacent extremities of the conveyor belt 20 and of the frame 24, respectively, carrying the belts 33 and 34. In between the sleeve 61 and the aforementioned roller 59 a return spring 63 is placed. The prongs of the said fork shaped member 62 run in a sliding fashion in guide slots machined into a sleeve 64 which, in turn, is mounted in such a way that it slides in a guided fashion on a rod 65 carried horizontally by the frame 2 above and parallel to rod 58.

Figure 2:
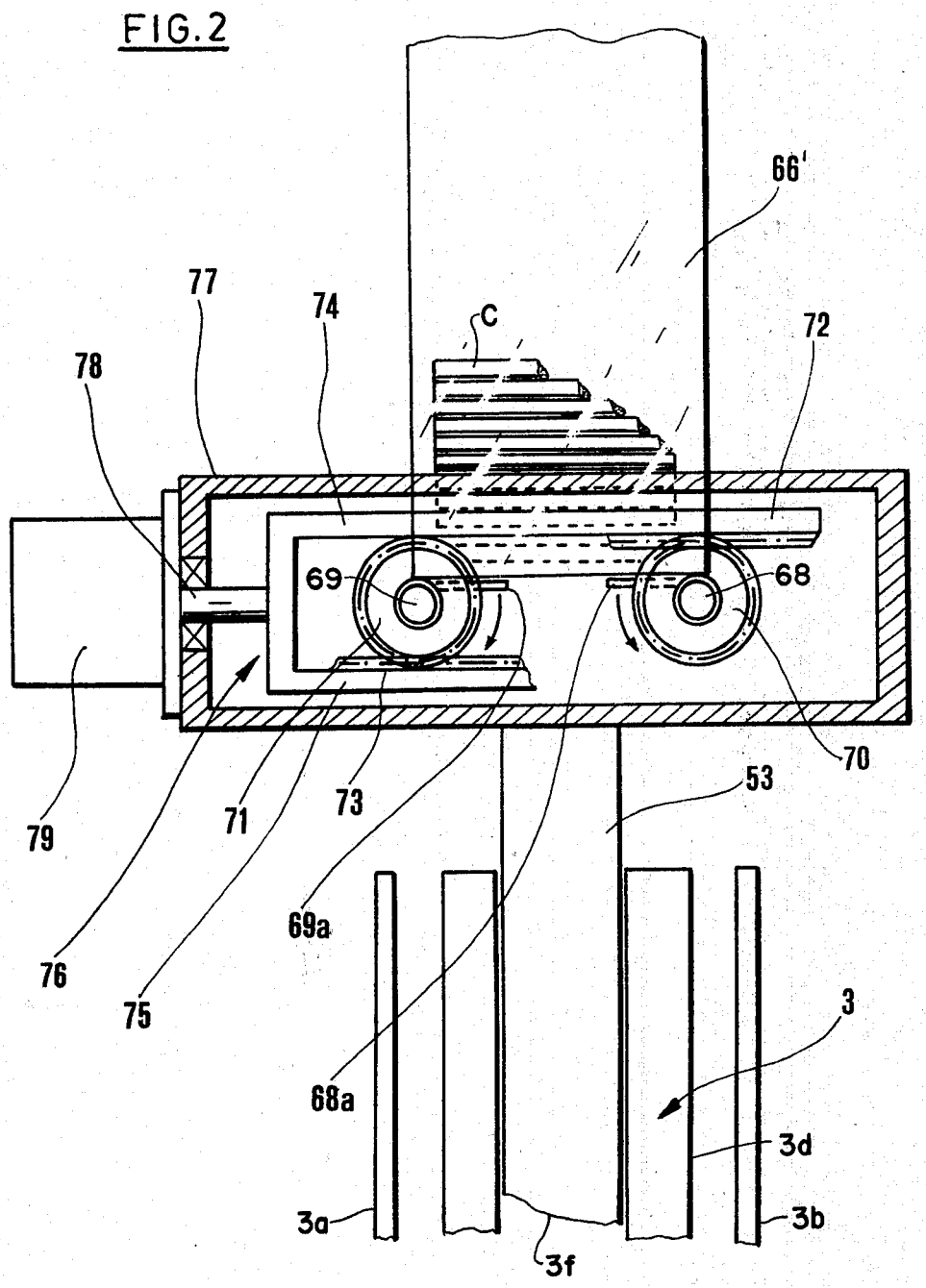
FIG. 2 shows, on an enlarged scale, a detail of the apparatus partly in elevation and partly in a sectional view taken along lines 2—2 in FIG. 1.

The rectangular frame 52 is constituted by (see also FIG. 2) two support members 66 and 67 defining the short sides of the rectangle and by two rods 68 and 69 defining the long sides of the rectangle and carried by the support members 66 and 67 in a way in which they are free to rotate. The rods 68 and 69 are provided with strips 68*a* and 69*a*, respectively, mounted horizontally in identical positions in the space between the two rods, for the support of cigarettes C. On their free end, which projects with respect to the support member 66, the rods 68 and 69 have, furthermore, rigidly mounted on them pinions, 70 and 71, respectively, the former meshing with a rack 72 carried by an arm 74 of a fork shaped member 76 (see FIG. 2) enclosed in a box 77 supported in any known way by the aforementioned support member 66, inside which it slides in a guided fashion and the latter meshing with a rack 73 carried by a second arm 75 of the fork shaped member 76. The fork shaped member 76 is provided with a shank 78 and this ends at the armature of an electromagnet 79 fixed to the above mentioned box 77.

On the brackets 53 and 54 which carry the aforementioned frame 52 are mounted, immediately below this frame, parts of a photoelectric cell device, numbered 80 and 81. The support members 66 and 67 carry, fixed thereto, wall members 66' and 67', respectively.

Figure 3:
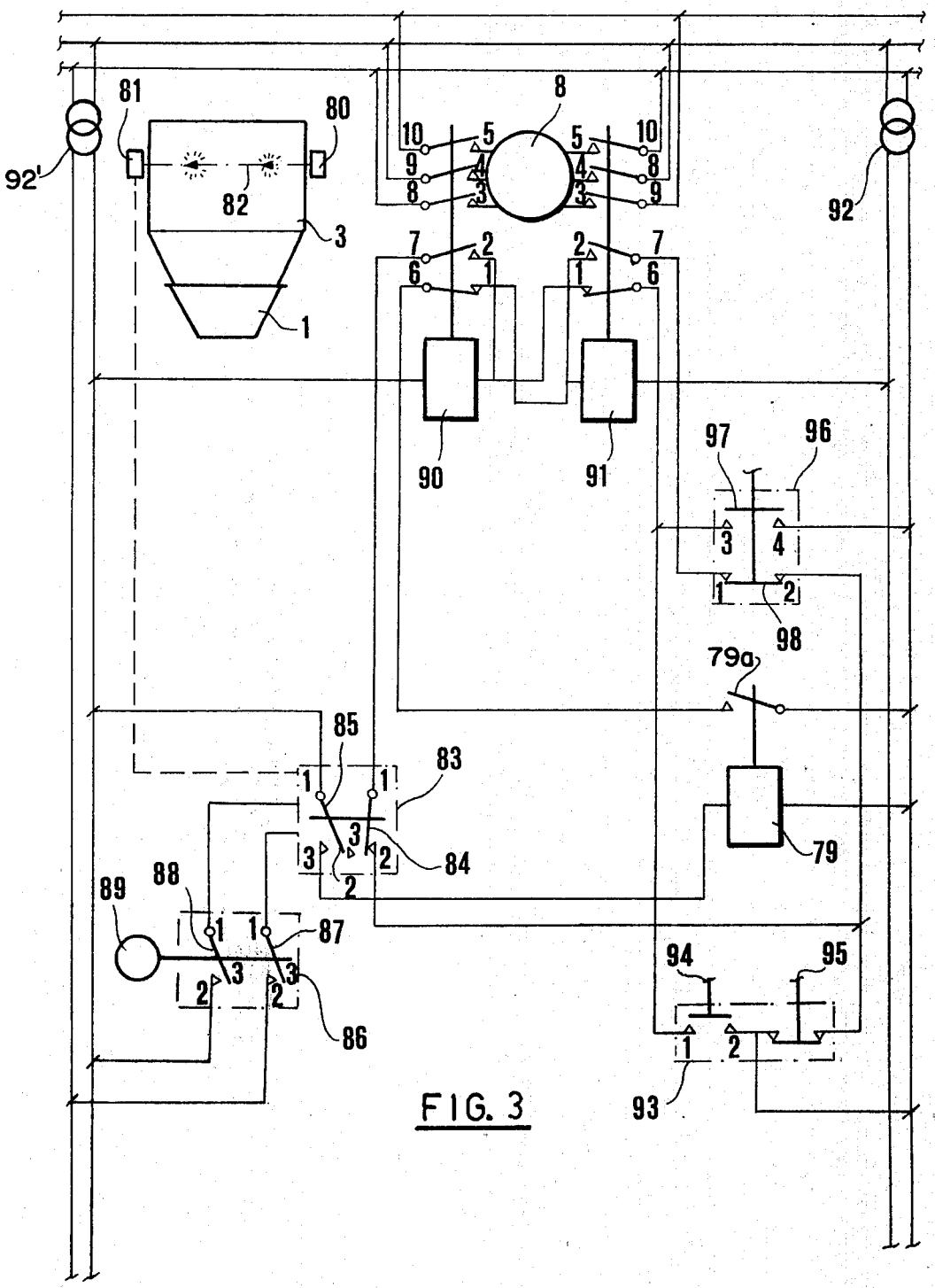
FIG. 3 shows, diagrammatically, an electromechanical operating system of the new apparatus.

FIG. 3 depicts, in diagrammatic form, the hoppers 1 and 3, the electric geared motor 8 and the component parts 80 and 81 of the photoelectric cell device connected to the frame 52. The part 80 consists of a lamp with a device for projecting a ray of light 82 towards a photocell (part 81) so positioned that it is hit by the ray of light 82 when the cigarettes supplied to the hopper 3 are at a level below that of the ray of light 82.

The photoelectric cell 81 controls an amplifier 83, two micro-contacts of which are shown, namely, a normally closed micro-contact 84 and a normally open micro-contact 85, these being movable from a position 84/1-2, 85/1-2 to a position 84/1-3, 85/1-3, respectively. The amplifier 83 works in conjunction with a micro-switch 86 with two contacts 87 and 88, movable from a closed position 87/1-2, 88/1-2 to an open position 87/1-3, 88/1-3, respectively.

The micro-switch 86 is, in turn, connected to an assembly 89 for manually preparing the apparatus to be switched in or for switching it out.

FIG. 3 also shows two contactors 90 and 91, transormers 92', a pushbotton unit 93 with two contacts 94 and 95, the former normally open for starting the apparatus up by hand and the latter normally closed for stopping it, also manually.

A micro-switch 96 (which can also be seen in FIG. 1) is provided with a normally open contact 97 and a normally closed contact 98. As also shown, the aforementioned electromagnet 79 is provided with a pair of normally open contacts.

The modus operandi for causing the apparatus to operate and the actual way in which the operation takes place are described below.

When the frame 52 and the fork shaped member 62 are in downward positions, the cigarettes delivered from the production machine by the conveyor belt 20 are carried on the belts 33 and 34, to the fixed wall 24', and accumulate against this wall.

By contrast, in an upper position (seen in FIG. 1) of the frame 52, the fork shaped member 62 intercepts the flow of cigarettes arriving on the conveyor belt 20.

The apparatus can be assumed to be initially immobile in this upper position, and to have on the frame 52, between the walls 66' and 67', a quantity of cigarettes, delivered by belt 20 as described. This quantity is then to be carried downwards into the inside of the hopper 3.

For these purposes, the assembly 89 is set in the automatic operation position, in which the contacts of the micro-switch 86 are carried to the closed position 87/1-2 and 88/1-2, respectively, thereby rendering operative the amplifier 83 controlled by the photoelectric cell device 80-81.

At this juncture it is necessary start the apparatus and for this purpose, as explained, to press the pushbutton 94 so as to close its auxiliary contacts 94/1-2. When this has been done, through the pair of normally closed contacts 91/1-6 of the contactor 91, the contractor 90 is energized, closes its normally open contacts. It stays self excited through one pair of these contacts, 90/2-7, the normally closed contact 84 of the amplifier 83 controlled by the photoelectric cell 81, and the normally closed contact 95 of the manual stop pushbutton 93 for the apparatus.

With the energizing and subsequent self-excitation of the contactor 90 its other pairs of normally open contacts 90/3-8, 90/4-9 and 90/5-10 also close and cause the geared motor 8 to be set in motion and move the chains 12 and 13 in the direction of the arrow. The movement of the chains, by brackets 56,57 extending through slots **3*e*, 3*f*, brings about the downward motion of the frame 52 towards the inside of the hopper 3. The chains 12, 13, as noted, also carry the idle rollers 56,57; therefore the downward motion of the chains and of frame 52 is accompanied by downward motion of shaft 57a, rod 58, sleeve 61 and fork 62. Thus, upon the downward displacement of the frame 52, the cigarettes on the conveyor belt 20 no longer have their movement impeded by the fork shaped member 62. They are now able to flow on to the support belts 33 and 34 which, are then free to receive them and to accumulate them, up to the upper pair of belts 38 and 39 and against the end wall 24'**, holding them parallel with one another.

When, during the downward movement of the frame 52, the ray of light 82 from the photoelectric cell device is broken by cigarettes accumulated in the hopper 3, the pairs of contacts 84 and 85 of the amplifier 83 go from position 84/1-2 and 85/1-2 to position 84/1-3, and 85/1-3 that is to say, the contact 84 opens and the contact 85 closes.

With the opening of the contact 84, the self-excitation circuit through contact 90/7-2 of contactor 90 is opened, de-energizing this contactor, and thus the movement of the geared motor 8 and of the frame 52 is halted at 90-5/10 etc., while the closing of the contact 85 causes the electromagnet 79 to be excited; it remains in this condition as long as the ray of light 82 if broken. With the attraction of its core, the excitation of the electromagnet 79 causes the rods 68 and 69 of the frame 52, and thus also the strips **68*a* and 69*a*** thereof, to rotate in mutually opposite directions as shown by the arrows (see FIG. 2) in order to release and discharge on to the cigarettes below, the layer of cigarettes resting on the strips, previously received thereon as described hereinafter.

The excitation of the electromagnet 79 also brings about the closing of its auxiliary pair of contacts **79*a*. Thus, through the normally closed pair of contacts 90/1-6 of the contactor 90 which, as previously seen, is in a de-energized state, the contactor 91 is excited, which thus closes its contacts 91/ and remains self-excited through the pair of contacts 91/2-7 with which it is provided and the normally closed contact 98 of the micro-switch 96**.

With the energizing and subsequent self-excitation of the contactor 91, its pairs of contacts 91/3-9, 91/4-8 and 91/5-10 close causing the geared motor 8 to be set in motion with the shaft rotating in the reverse direction to that to which previous reference has been made. Therefore, again through the chains 12 and 13, an upward movement of the frame 52 (with which the layer of cigarettes has been previously carried downwards) is released.

While this upward travel of the frame 52 is taking place and once the layer of cigarettes newly deposited in hopper 3 has been used up in the packeting machine, the ray of light 82 ceases to be broken and as a result of this the contacts 84 and 85 return to their normal positions 84/1-2, 85/1-2. The latter contacts thereby de-energize the electromagnet 79 so as to allow the strips **68*a* and 69*a*** to go back to their original support position under the action of return springs, not illustrated.

Continuing its upward travel, the frame 52 first halts, through its fork shaped member 62, the flow of cigarettes from the conveyor belt 20 to the belts 33 and 34. The frame 52 then travels horizontally along guides **4*a*, 5*a* to meet the frame 24 and, frame against the action of the return springs 27 and 28, forces this frame back against the plate 49. This operation evidently causes the cigarettes accumulated on frame 24 to be transferred from this frame to the frame 52. It also causes the frame 24 to depress the pushbutton of the micro-switch 96 thereby closing the contact 97 and opening the contact 98. The opening of contact 98 de-energizes contactor 91 and thereby brings the geared motor 8 and the frame 52** to a standstill.

The closing of the contact 97 causes excitation of the contactor 90 through the pair of normally closed contacts 91/1-6 of the contactor 91, and thereby causes the geared motor 8 to be set in motion again in such a way as to carry the frame 52 downwards in order to repeat the operations described above for conveying the accumulated quantity of cigarettes, previously removed from frame 24 to frame 52 at a high level position, to the low level discharge position in the inside of the hopper 3. It will be understood that during the short time needed for the transferring of the accumulated cigarettes from frame 24 to frame 52, the newly produced cigarettes supplied by the ciarette producing machine accumulate on belts 20 against the fork member 62. It will also be understood that the new apparatus accumulates cigarettes to suit the capacity of the producing and delivering unit as well as the capacity of the packeting machine and hopper, and that it operates with great simplicity and reliability, and with the required, considerable speed.

What is claimed is:

1. Apparatus for transferring goods produced by a producing machine to a packeting machine, comprising;

a hopper for receiving newly produced goods and for delivering them to be packeted;

a conveyor conveying the newly produced goods in a continuous flow, and having a delivery portion upstream of the hopper, to which portion it delivers the flow of products;

separating and accumulating means in the delivery portion for separating from the continuous flow a quantity of goods and for accumulating said quantity in the delivery portion during each of a succession of cycles;

transportation means for transporting during a part of each cycle, the then accumulated quantity of goods from the delivery portion into the hopper, the transportation means comprising a support for the accumulated goods and discharging means for discharging the goods from the support;

detecting means for detecting a level of goods in the hopper and for actuation of the discharging means to discharge the goods when the detected level falls below a predetermined position; and driving means for (1) moving the transportation means in each cycle from a transfer position of the support, wherein the accumulated quantity of goods is shifted from the delivery portion onto the support, to a position above the hopper, and downwardly therefrom into the hopper to a discharge position of the support for the discharging of the accumulated goods from the support into the hopper upon the actuation of the discharging means, and for (2) returning the transportation means in each cycle, after said discharging, from the discharge position to the transfer position.

2. Apparatus according to claim 1, in which the detecting means has means for electro-optically performing the detecting of the level of goods in the hopper.

3. Apparatus according to claim 1 in which said delivery portion comprises primary belt means in line with the conveyor; secondary belt means superposed to and parallel with the primary ones; a vertical plate located at a first end of the primary and secondary belt means remote from the conveyor; and vertical stop means insertable at a second end of said belt means, adjacent the conveyor.

4. Apparatus according to claim 3 in which the vertical stop means is secured to the transportation means to move with it.

5. Apparatus according to claim 1 in which the hopper has an upper extremity lying in a vertical plane, and the separating and accumulating means comprises a continuous belt receptive of goods from the continuous flow of goods and extending in the proximity and throughout the upper extremity of the hopper in a vertical plane spaced away from and parallel with that of the hopper.

6. Apparatus according to claim 3 in which the delivery portion comprises a frame receptive of the products; supporting shafts for supporting the frame; a vertical plate extending downwardly to the primary belt means on a side of the frame remote from the hopper; and means enabling the transportation means elastically to slide the frame along the supporting shafts toward and beyond the vertical plate while stopping the accumulated goods by said plate, to transfer the goods from the frame to the transportation means.

* * * * *